US006895727B2

(12) United States Patent
Ogura

(10) Patent No.: US 6,895,727 B2
(45) Date of Patent: May 24, 2005

(54) METHOD OF PACKAGING A TRANSFER PICTURE TRANSFERRING MEMBER AND MAINTAINING ITS WATER CONTENT

(75) Inventor: Motohiro Ogura, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 138 days.

(21) Appl. No.: 10/421,703

(22) Filed: Apr. 24, 2003

(65) Prior Publication Data

US 2005/0076614 A1 Apr. 14, 2005

Related U.S. Application Data

(63) Continuation of application No. 09/067,012, filed on Apr. 27, 1998, now abandoned.

(30) Foreign Application Priority Data

May 12, 1997 (JP) ..... 9/120881
Apr. 21, 1998 (JP) ..... 10/110707

(51) Int. Cl.[7] ..... B65B 25/14
(52) U.S. Cl. ..... 53/428; 53/473

(58) Field of Search ..... 53/473, 428, 431, 53/461

(56) References Cited

U.S. PATENT DOCUMENTS 5,488,455 A 1/1996 Cahill et al.
5,662,995 A 9/1997 Sakurai et al.

FOREIGN PATENT DOCUMENTS

JP 52-82509 7/1977
JP 4-361086 12/1992

*Primary Examiner*—Stephen F. Gerrity
(74) *Attorney, Agent, or Firm*—Fitzpatrick, Cella, Harper & Scinto

(57) ABSTRACT

The present invention provides a transfer picture transferring member which prevents occurrence of simultaneous feed of two or more sheets, inhibits the amount of curling of paper in various environments, and prevents occurrence of curling even when taking out a sheet of paper from the package. The transfer picture transferring member having a transferring layer on a surface of the substrate of the invention is characterized by a water content within a range of from 4 to 6%.

8 Claims, 3 Drawing Sheets

201, 202, 203 : PAPER FEED TRAY
204, 205, 206 : PAPER FEED ROLLER
207 : COPYING DRUM
208 : ATTRACTING BRUSH
211 : PHOTOSENSITIVE DRUM
216 : COPYING BRUSH
218 : FIXING UNIT 201, 202, 203 : PAPER FEED TRAY
204, 205, 206 : PAPER FEED ROLLER
207 : COPYING DRUM
208 : ATTRACTING BRUSH
211 : PHOTOSENSITIVE DRUM
216 : COPYING BRUSH
218 : FIXING UNIT

METHOD OF PACKAGING A TRANSFER PICTURE TRANSFERRING MEMBER AND MAINTAINING ITS WATER CONTENT

This is a continuation of U.S. patent application Ser. No. 09/067,012, filed Apr. 27, 1998, and allowed Jan. 24, 2003 now abandoned.

BACKGROUND OF THE INVENTION

1. Field of the Invention

The present invention relates to a transfer picture re-transferring member used for re-transferring a formed toner image onto a re-transfer medium. More particularly, the present invention relates to a transfer picture transferring member used for re-transferring a toner image formed by an electrophotographic unit or an electrostatic recording unit, and a toner image re-transferring method using the same.

2. Description of the Related Art

Three-dimensionally transferring an image by the use of a transfer picture technique is known: the commonly-known conventional water pressure transferring method comprises the steps of coating a water-soluble paste as typically represented by dextrin onto a substrate such as a sheet of paper, forming a desired image on the coated film using an acrylic ink by screen printing or the like, dissolving dextrin by dipping the image-bearing paper into water, and transferring the acrylic ink image floating on water onto a three-dimensional object such as china. In an example of direct application of the transferring paper used in this method to electrophotography, re-transferring is accomplished by the steps of preparing a transferring member by forming a dextrin film on the sheet of rice paper, forming a toner image on the surface of dextrin by means of an electrophotographic unit, then, passing the transferring member through an organic solvent capable of causing a resin in the toner to soften, imparting to the toner image adhering power to a transfer medium onto which re-transferring is to be made (hereinafter referred to the "re-transfer medium"), bringing the transferring member into contact with the re-transfer medium so that the toner image is in direct contact with the re-transfer medium, and then, supplying water from the back of the paper to dissolve the dextrin film, thereby transferring only the toner image.

Japanese Patent Laid-Open No. 4-361,086 proposes a transferring member using polyvinyl alcohol, a saponified vinyl acetate, in place of dextrin. The transferring member comprises a silicone resin coated onto paper, an acrylic resin layer formed thereon, and further, a mixture of CASSESOL made by the Nikka Kagaku Company and a silicone anti-foaming agent coated thereon. Re-transferring is accomplished by forming a toner image on the coated film by means of an electrophotographic unit, then stripping off the CASSESOL film from the substrate, and bringing the toner image into direct contact with the re-transfer medium.

Adhesion to the re-transfer medium is obtained by causing the resin contained in the foregoing toner image by heating and applying a pressure, and an aqueous 80% ethyl alcohol solution is applied from the back of the CASSESOL film after cooling to reduce adhesion between the CASSESOL film and the toner image, thus completing re-transferring.

Another transfer picture technique of re-transferring an image formed by an electrophotographic unit onto a re-transfer medium is disclosed, for example, in Japanese Patent Laid-Open No. 52-82,509. A transfer medium used in this transfer picture is available, for example, by forming an undercoat layer comprising methyl methacrylate-n-butyl copolymer, polyvinyl acetate homopolymer emulsion, vinyl chloride homopolymer latex, and/or vinyl chloride acrylate latex, alone or in combination, on a paper or plastic film having a stripping layer having a high strippability, comprising a silicone resin or a fluororesin, formed thereon.

The subsequent steps comprise forming a toner image on the thus completed transferring member in an electrophotographic unit, applying a fixing operation at least to an extent that the tone does not peel off, heating, and applying a pressure to, the transferring member after fixing while bringing the same into contact with the re-transfer medium (cloth, etc.) so that the toner image is in direct contact with the medium, until the toner and the undercoat layer of the transferring member soften, cooling the assembly, and stripping off the paper or the like having a stripping layer while leaving the toner image and the undercoat layer on the transferring member side, thus completing re-transferring.

In these cases, however, the paper is exposed on the back, and consequently, the paper may sometimes suffer serious curling, depending upon the environment in which the transferring member is left.

In view of these circumstances as described above, a technique is proposed, which prevents curling by forming a resin lining layer.

However, when forming a high-bridging resin simply into a filler layer, the water feed rate of resin differs between the copied and non-copied sides of the paper, and upon unpacking the paper, serious curling occurs to make it impossible to feed the paper within the electrophotographic unit.

Particularly, when the copied side is formed with a polymer material hardly susceptible to the effect of humidity such as a vinyl resin, a polyurethane resin, an epoxy resin or a polyamide resin, or when the back side is formed by impregnating with a resin (paper fibers are exposed), or formed with a polymer easily susceptible to the influence of humidity, serious curling is caused.

When the same resin is used for the surface and the back, a high affinity of resin results in simultaneous feed of two or more sheets.

SUMMARY OF THE INVENTION

The present invention has therefore an object to provide a transfer picture transferring member which prevents simultaneous feed of two or more sheets, inhibits paper curling in various environments, and inhibits occurrence of curling even upon unpacking the paper.

In accordance with these and other objectives, there is provided a method of packaging a transfer picture transferring member, the method including the steps of providing a transfer picture transferring member comprising a substrate having a front surface and a back surface, a front resin layer formed of a first resin on the front surface of the substrate and a back resin layer formed of a second resin different from the first resin on the back surface of the substrate. The method includes the step of adjusting a water content of the transfer picture transferring member to a range from 4 to 6%, packing the transfer picture transferring member in a package and maintaining that water content of the transfer picture transferring member in the package within the range of 4 to 6%.

Another object of the invention is to provide a method of forming a satisfactory toner image and re-transferring the toner image onto a re-transfer medium without the risk of causing curling. More specifically, the invention relates, in a transfer picture transferring member having a resin layer on the surface of a substrate, housed in a package, to a transfer picture transferring member with the water content in the package adjusted within a range of from 4 to 6%.

The invention has a further object to provide a method of re-transferring a toner image, comprising a step of forming a toner image, by the electrophotographic method, on the surface of a transferring layer of a transfer picture transferring member with a water content in the package adjusted within a range of from 4 to 6%, a step of bringing the toner image formed on the transfer picture transferring member into contact with a re-transfer medium, and a step of transferring the transferring layer and the toner image onto the re-transfer medium through heating and application of a pressure.

The water content in the transfer picture transferring member is a percentage of the water content in weight ($W_2$) relative to the total weight ($W_1$) of the transfer picture transferring member, i.e., $W_2/W_1 \times 100$ (%). In the present invention, it is possible to prevent occurrence of curling posing problems in the course of taking out a transfer picture transferring member and forming a toner image by adjusting the water content in the transfer picture transferring member as housed in the package within a range of from 4 to 6%. Particularly, because no curling or substantially no curling occurs in the transfer picture transferring member, it is possible to accurately reproduce a toner image formed on a photosensitive member onto a transfer picture transferring member in the electro-photographic process, and carry out uniform fixing of the toner image.

DESCRIPTION OF THE PREFERRED EMBODIMENTS

As a substrate for the transfer picture transferring member, a resin film is applicable, but paper is particularly suitable. The transfer picture transferring member should preferably have resin layers in the form of a stripping layer on the surface of the substrate and a transferring layer on the stripping layer. The transfer picture transferring member should preferably have an amount of curling of up to 5 mm in an environment at 23° C. and an RH of 60%, and an amount of curling of up to 5 mm in an environment at 30° C. and an RH of 80%. The back of the transfer picture transferring member should preferably have an intrinsic surface resistance within a range of from $1\times10^{10}$ to $2\times10^{12}$. To ensure that the transfer picture transferring member in the package keeps a prescribed water content, the package should preferably have a moisture permeability of up to 15 $g/m^2/24$ hr. The moisture permeability is measured according to JIS Z0208. Applicable package materials include a resin wrapping material and an aluminum vapor-deposited paper.

Now, the present invention will be described further in detail with reference to the drawings.

Figure 1:
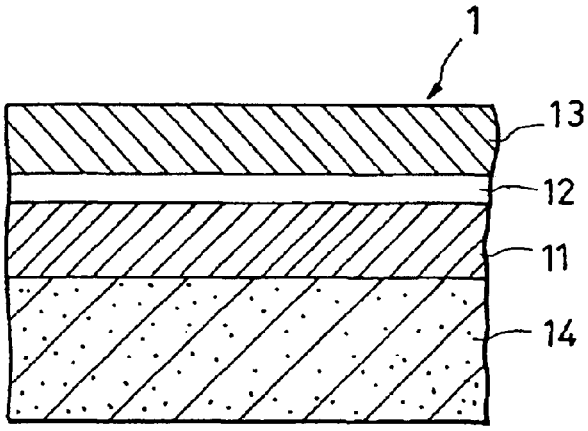
FIG. 1 is a schematic sectional view of a transfer picture transferring member.

FIG. 1 is a schematic view illustrating the layer configuration of the transfer picture transferring member of the invention; 11 is a substrate of the transferring member 1 which is a middle or high-quality ordinary paper. The basis weight should preferably be within a range of from 30 to 200 $g/m^2$, or more preferably, from 45 to 150 $g/m^2$.

Also in FIG. 1, there is a stripping layer 12. When re-transferring, it is necessary to leave a transferring layer 13 on the re-transfer medium side. A material having a larger surface energy than the transferring layer is therefore employed, such as a silicone resin or a fluororesin.

The resin used for the transferring layer 13 should preferably have a high bridging property; hardly susceptible to the effect of humidity, and give no image transferring defect in various environments. The applicable materials include, for example, a vinyl resin, a polyurethane resin, an epoxy resin and a polyamide resin.

A filler layer 14 may be provided on the back of the substrate. In this case, the filler layer should preferably be formed by silk screen printing because it permits easy forming of a patterned filler layer. That is, when the paper is completely covered with the filler layer, feedability of the transfer picture transferring member in the electrophotographic unit is reduced. Silk screen printing will be described later.

It is therefore desirable that the paper is not covered completely so as to allow penetration of a slight amount of water into the paper. Impregnation of the paper with a filler resin improves feedability of the paper upon coating. The surface and the back of the transfer picture transferring member should preferably be coated with resins of different kinds. Coating both sides with a resin may cause simultaneous feed of two or more sheets of transferring member.

The material resin for the filler layer should preferably have a high permeability to paper, and be hardly susceptible to the influence of humidity, with a low viscosity. Applicable materials include, for example, thermoplastic resins such as acrylic and vinyl resins, and thermosetting resins such as phenol, urea melamine, alkyd, epoxy and urethane resins. A surface roughening agent such as silica or clay may be added to prevent occurrence of defective biting of the fixing unit.

Figure 4:
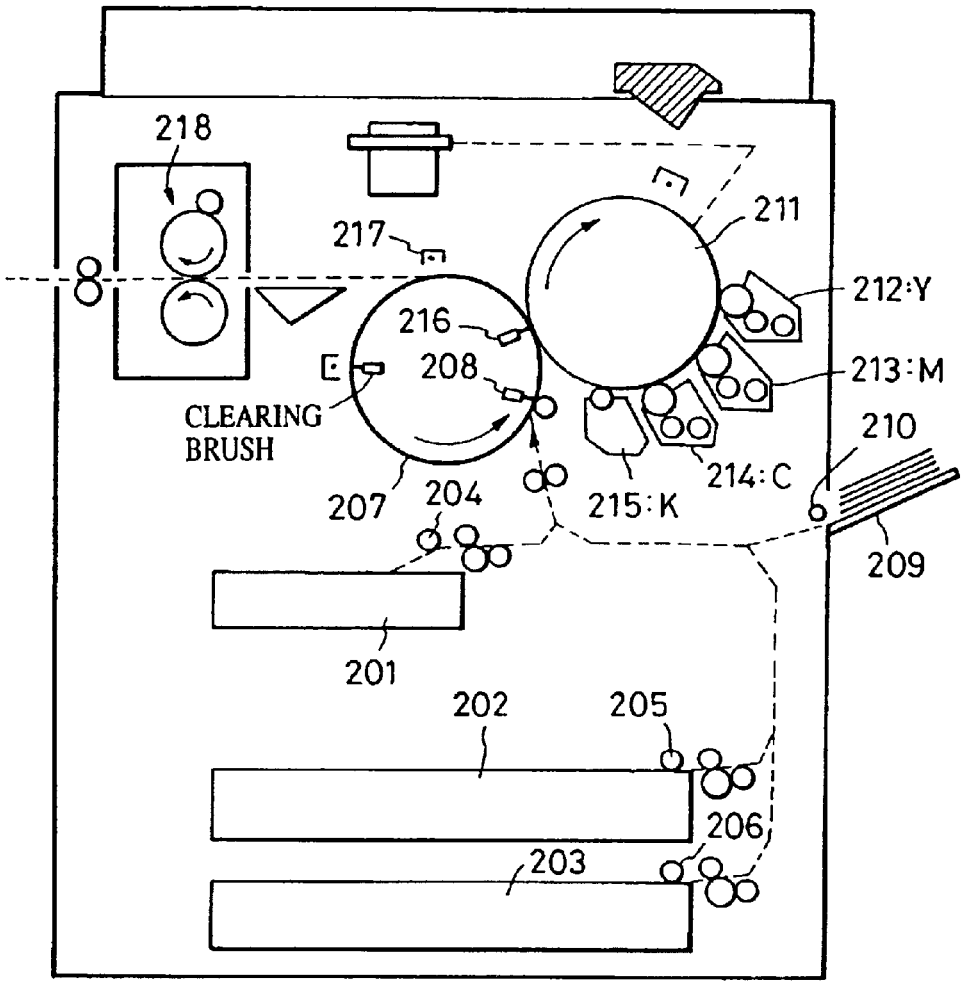
FIG. 4 illustrates a configuration of the electrophotographic unit used in the invention.

FIG. 4 is a side view illustrating the inside configuration of a color re-transferring machine used in the invention. The transferring member withdrawn by paper-feed rollers 204, 205 and 206 provided above paper-feed trays 201, 202 and 203 one by one is fed in the arrow direction, and then, electrostatically attracted by a transferring drum 207 by supplying current to an attracting brush 208. Similarly, the transferring member fed from a paper-feed roller 210 of a manual paper-feed tray 209 is also electrostatically attracted by the transferring drum.

A photosensitive drum 211 is provided at a position as shown in FIG. 4, and in the proximity thereof, there are arranged a yellow developing unit 212, a magenta developing unit 213, a cyan developing unit 214, and a black developing unit 215. The transferring member electrostatically attracted as described above rotates in the arrow direction until images formed by the four color developing units are copied onto the transferring drum 207 side by a transferring brush 216.

Upon completion of four-color transferring, the transferring member on the transferring drum 207 is separated from the transferring drum 207 by a separating charger 217, fed in the dotted-line arrow direction, and fixed by heat and pressure in the fixing unit 218, thus completing a series of color printing steps, thereby forming a desired full-color print.

The water content in the paper is determined by measuring on a sheet of paper taken out from a package containing sheets of paper in accordance with the paper set forth in JIS P 8127.

A water content in the package of under 4% leads to easy occurrence of curling and transfer peeling in a high-humidity (for example, an RH of 75%) environment.

An amount of curling of over 5 mm results in difficultly in feeding. In the invention, the amount of curling is determined by measuring the height at the four corners of paper, and using the maximum height as the amount of curling.

An amount of curling of over 6% leads to a lower resistance of the back side, tending to cause difficulty in electrostatically attracting to the transferring drum.

The back side should preferably have an intrinsic surface resistance (JIS K 6911) within a range of from $1\times10^{10}$ to $2\times10^{12}$ Ω/□.

An intrinsic surface resistance of under $1\times10^{10}$ Ω/□ tends to lead to difficult electrostatic attraction, and a resistance of over $2\times10^{12}$ Ω/□ tends to result in greater occurrences of curling in a high-humidity environment.

Figure 2:
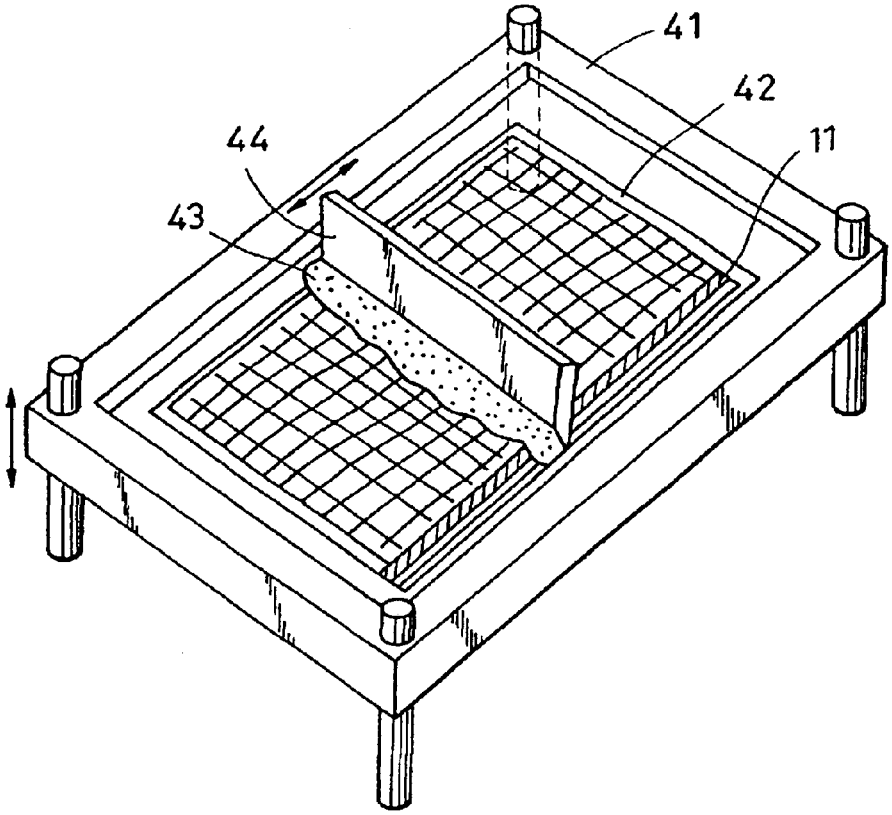
FIG. 2 is a schematic perspective view of a screen printing machine.
Figure 3A:
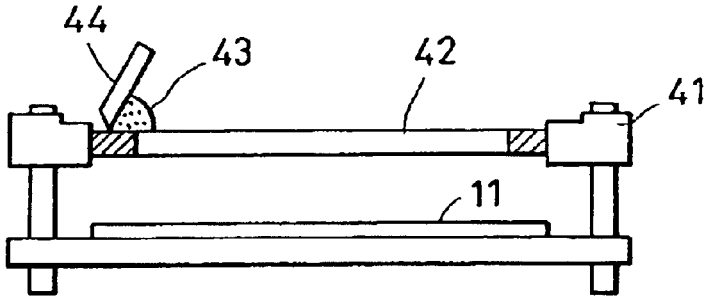
FIGS. 3A–3D illustrate a process of screen printing.
Figure 3B:
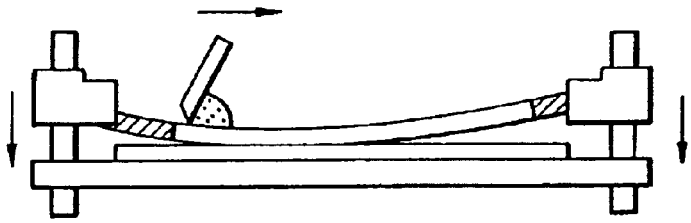
Figure 3C:
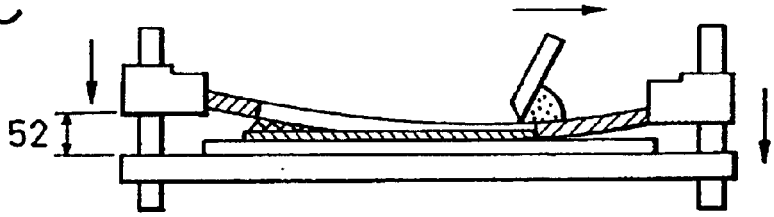
Figure 3D:
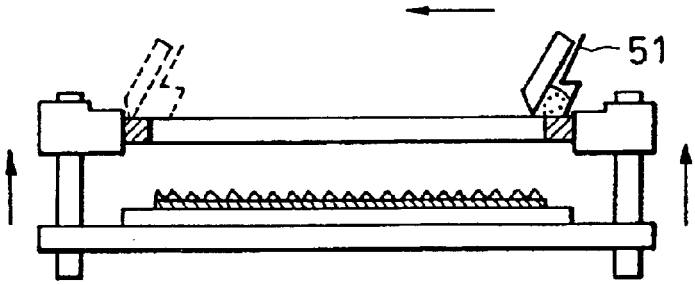

FIG. 2 is a schematic perspective view of a screen printing machine, and FIG. 3 is a cross-sectional view illustrating the process of screen printing. The screen printing process comprises the steps of fixing with tension four sides of a screen (a meshy fabric (made mainly of nylon, tetron or stainless steel)) 42 to a frame 41, and making a printing film thereon manually or by an optical technique. Printing is carried out by supplying a screen printing ink 43 into the shallow arc-shaped frame 41, and rubbing the screen having thereon the printing film in the frame with a thick rubber spatula known as a squeegee 44 while applying the pressure, whereby the ink is pushed off from the printing film through the screen 42 onto the surface of an object 11 to be printed placed under the screen, thereby accomplishing printing.

Printing of this type is characterized in that it is possible to change the mesh of the screen 42 by replacing the frame 41, and to control the thickness and surface quality of the coated film by means of the material of the screen 42, hardness and angle of the squeegee, or the distance between the frame 41 and the surface to be printed.

Printing is carried out by first filling the frame 41 with a printing ink 43 as shown in FIG. 3(*a*), adjusting hardness, angle and pressurizing force of the squeegee 44, lowering the frame 41 as shown in FIG. 3(*b*), this causing the squeegee 44 to move, whereby the ink 43 is coated onto the surface to be printed through the screen 42 as shown in FIG. 3(*c*), and then completing printing along with the rise of the frame 41 again as shown in FIG. 3(*d*). The remaining ink 43 is retained at an ink scraper 51, and used for the repeated cycle in the next run of printing.

For multi-layer coating, printing comprising the same steps is applied one by one, and after drying, the next layer is coated through the same cycle of steps.

However, when, upon one-side coating of paper, forming a filler layer seals the back of the substrate, it becomes difficult to coat the surface of the substrate.

Storage of the transfer picture transferring member will now be described below.

Because an ordinary polyethylene-coated wrapping paper has a high moisture permeability of 30 g/m$^2$/24 hr, the water content in the wrapped transfer picture transferring member increases by 2 to 3% during summer season in Japan for one to two months. Upon consequent use, curling may suddenly occur when the member is taken out from the package. The moisture permeability of the package should therefore preferably be up to 15 g/m$^2$/24 hr, or more preferably, up to 10 g/m$^2$/24 hr.

EXAMPLE 1

A stripping layer comprising a silicone resin (trade name: SR2411, manufactured by Joray Dow Chemical Co.) was formed in the thickness of 10 μm on a sheet of high-quality paper having a basis weight of 80 g/m$^2$, and further a transferring layer comprising a hot-melt type of urethane resin (trade name: AG-946SB, manufactured by Dai Nippon Ink Co. Ltd.) was formed in the thickness of 14 μm thereon.

This transferring member was left in an environment at 23° C. and an RH of 40% for a night (for about 12 hours) to dry, and the water content in a package was adjusted to 5%. In this state, the transferring member was stored in a vapor-deposited aluminum bag (moisture permeability: 3 g/m$^2$/24 hr): the transferring member side showed an intrinsic surface resistance of $1\times10^{12}$ Ω/□ and the other side, $1\times10^{11}$ Ω/□. This state was sufficiently maintained for several months.

As a result, no curling occurred even when the member was left for three minutes in a high-humidity environment (an RH of 75%). Silk screen printing suffered no inconvenience, and peeling was not caused during feed within the electrophotographic unit.

EXAMPLE 2

A transferring member was prepared in the same manner as in the Example 1 except that a filler layer was formed by the use of acrylic water-soluble emulsion (trade name: Acryl Cover-Coat Resin, manufactured by Goou Kagaku K. K.) on the back of a high-quality paper. The filler layer is the portion which contains the acrylic resin penetrated into the high-quality paper.

Then, the water content in the package was adjusted to 6% in the same manner as in the Example 1 except that the holding time was reduced to 4/5 (about 10 hours), and stored in a vapor-deposited aluminum bag as in the Example 1. The transferring layer side had an intrinsic surface resistance of $8\times10^{11}$ Ω/□ and the other side showed an intrinsic surface resistance of $1\times10^{10}$ Ω/□.

The result is shown in Table 1.

EXAMPLE 3

A transferring member was prepared in the same manner as in the Example 2 except that the transferring layer comprised PVA (trade name: Kuraray Poval PVA 110, manufactured by Kuraray Co. Ltd.).

Then, the water content in the package was adjusted to 6% by leaving the transferring member for a night in an environment at 23° C. and an RH of 50%. Two 100 μm-thick polyethylene sheets were bonded together, and stored in a bag having a moisture permeability of 14 g/m$^2$/24 hr.

The result is shown in Table 1.

COMPARATIVE EXAMPLE 1

A transferring member was prepared in the same manner as in the Example 1.

Then, a drying step was repeated twice, and the water content in the package was adjusted to 3% without holding. The resultant transferring member was stored in the same bag as in the Example 1.

The result is shown in Table 1.

COMPARATIVE EXAMPLE 2

A transferring member was prepared in the same manner as in the Example 1.

Then, after holding for a night in an environment at 30° C. and an RH of 70%, the water content in the package was adjusted to 8%. The resultant transferring member was stored in the same bag as in the Example 1.

The result is shown in Table 1.

COMPARATIVE EXAMPLE 3

A transferring member was prepared in the same manner as in the Example 2.

Then, a drying step was repeated twice, and the water content in the package was adjusted to 3% without holding. The resultant transferring member was stored in an aluminum bag.

The result is shown in Table 1.

COMPARATIVE EXAMPLE 4

A transferring member was prepared in the same manner as in the Example 2.

Then, after holding for a night in an environment at 30° C. and an RH of 70%, the water content in the package was adjusted to 8%. The resultant transferring member was placed in an aluminum bag.

The result is shown in Table 1.

packing said transfer picture transferring member in a package; and maintaining the water content of said transfer picture transferring member in the package within the range of from 4 to 6%.

2. A method according to claim 1, wherein the provided substrate is paper.

3. A method according to claim 1, wherein in the transfer picture transferring member provided in said providing step said first resin layer comprises a stripping layer provided on the front surface of said substrate and a transferring layer provided on said stripping layer.

4. A method according to claim 3, wherein in the first resin layer of the transfer picture transferring member provided in said providing step, said stripping layer comprises a resin selected from the group consisting of silicone resins and fluororesins, and wherein said transferring layer comprises a resin selected from the group consisting of vinyl resins, polyurethane resins, epoxy resins and polyamide resins.

5. A method according to claim 1, wherein the steps of adjusting and maintaining the water content are so that an amount of curling of the packaged transfer picture transferring member in an environment at a temperature of 23° C. and a relative humidity (RH) of 60% is less than 5 mm.

6. A method according to claim 1, wherein the steps of adjusting and maintaining the water content are so that an amount of curling of the packaged transfer picture transferring member in an environment at a temperature of 30° C. and a relative humidity (RH) of 89% is less than 5 mm.

TABLE 1

| | Example 1 | Example 2 | Example 3 | Comparative example 1 | Comparative example 2 | Comparative example 3 | Comparative example 4 |
|---|---|---|---|---|---|---|---|
| Transferring layer | Urethane resin | Urethane resin | PVA | Urethane resin | Urethane resin | Urethane resin | Urethane resin |
| Stripping layer | Silicone resin | Silicone resin | Acrylic resin | Silicone resin | Silicone resin | Silicone resin | Silicone resin |
| Base layer | Paper | Paper | Paper | Paper | Paper | Paper | Paper |
| Filling layer | None | Aqueous acrylic emulsion | Aqueous acrylic emulsion | None | None | Aqueous acrylic emulsion | Aqueous acrylic emulsion |
| Water content in packing | 5% | 6% | 6% | 3% | 8% | 3% | 8% |
| Curling at high humidity (after lapse of 3 min.) | 2 mm | 1 mm | 2 mm | 50 mm | 0 mm | 40 mm | 0 mm |
| Defect in silk screen coating | ◎ | ◎ | ○ | ○ | ○ | ○ | ○ |
| Peeling | ◎ | ◎ | ○ | X | X | X | X |

◎: No problem

○: Not observed

Δ: Observed

X: Serious

What is claimed is:

1. A method of packaging a transfer picture transferring member, comprising the steps of:

providing a transfer picture transferring member comprising a substrate having a front surface and a back surface; a front resin layer formed of a first resin on the front surface of said substrate; and a back resin layer formed of a second resin different from the first resin on the back surface of said substrate;

adjusting a water content of said transfer picture transferring member to a range of from 4 to 6%;

7. A method according to claim 1, wherein the back surface of said substrate of the transfer picture transferring member provided in said providing step has an intrinsic surface resistance within a range of from 1×10E10 to 2×10E12 Ω□.

8. A method according to claim 1, wherein the water is adjusted and maintained so that said package has a moisture permeability of up to 15 g/m$^2$/24 hr.

* * * * *

UNITED STATES PATENT AND TRADEMARK OFFICE

CERTIFICATE OF CORRECTION

PATENT NO. : 6,895,727 B2
DATED : May 24, 2005
INVENTOR(S) : Motohiro Ogura

It is certified that error appears in the above-identified patent and that said Letters Patent is hereby corrected as shown below:

Column 1,
Line 38, "to" (2nd occurrence) should read -- to as --.
Line 66, "No. 52-82,509." should read -- No. 52-82509. --.

Column 4,
Line 23, "is not" should read -- not be --.

Column 5,
Line 11, "to" should be deleted.
Line 31, "from" should be deleted.

Column 7,
Lines 8, 18 and 28, "result is" should read -- results are --.

Column 8,
Line 60, "1x10E10" should read -- $1x10^{10}$ --.
Line 61, "2x10E12Ω□." should read -- $2x10^{12}$Ω□. --.

Signed and Sealed this

Fourth Day of October, 2005

JON W. DUDAS
*Director of the United States Patent and Trademark Office*